United States Patent [19]

Panetti

[11] 4,020,599

[45] May 3, 1977

[54] ABRADING ARRANGEMENT FOR A RAILWAY TRACK

[75] Inventor: Romolo Panetti, Geneva, Switzerland

[73] Assignees: Speno International S. A. and Frank Speno Railroad Ballast Cleaning Co., Inc., both of Geneva, Switzerland

[22] Filed: May 18, 1976

[21] Appl. No.: 687,606

[30] Foreign Application Priority Data

May 21, 1975 Switzerland ..... 006522/75

[52] U.S. Cl. ..... 51/178; 299/41

[51] Int. Cl.[2] ..... B24B 23/00

[58] Field of Search ..... 51/178; 299/41, 39; 404/90

[56] References Cited

UNITED STATES PATENTS

| | | | |
|---|---|---|---|
| 3,707,808 | 1/1973 | Danko et al. | 51/178 |
| 3,738,066 | 6/1973 | Panetti | 51/178 |
| 3,918,215 | 11/1975 | Scheucher | 51/178 |

FOREIGN PATENTS OR APPLICATIONS

| | | | |
|---|---|---|---|
| 1,060,027 | 11/1953 | France | 51/178 |

*Primary Examiner*—Harold D. Whitehead
*Assistant Examiner*—Roscoe V. Parker

[57] ABSTRACT

A series of abrading contact elements for truing the bearing surface of a railway track, in which the abrading elements are moved one behind the other tangentially of the bearing surface of the rail to be abraded or ground. The elements are arranged in the form of two groups of two elements. One of the elements move away from the rail when the other moves towards the rail. Each of the two groups is mounted in one inclinable beam which are interconnected so that a change in the inclination of one of the beams causes a change in the inclination of the other beam. The elements of the two groups are always tangential to the radius of curvature of the rail including positive and negative radii, and a straight line. Each beam is rotatably mounted about its central point between two grinders of the respective group, and the adjacent ends of the beams are linked by means of crossed rods of equal length so that one beam tilts in one direction, the other beam tilts in the opposite direction. One of the pivot points allows for lateral displacement of the beam.

7 Claims, 8 Drawing Figures

Fig.4
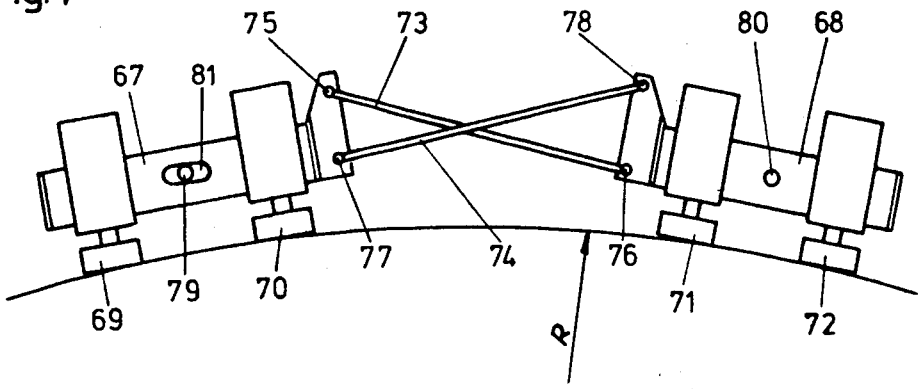
Fig.5
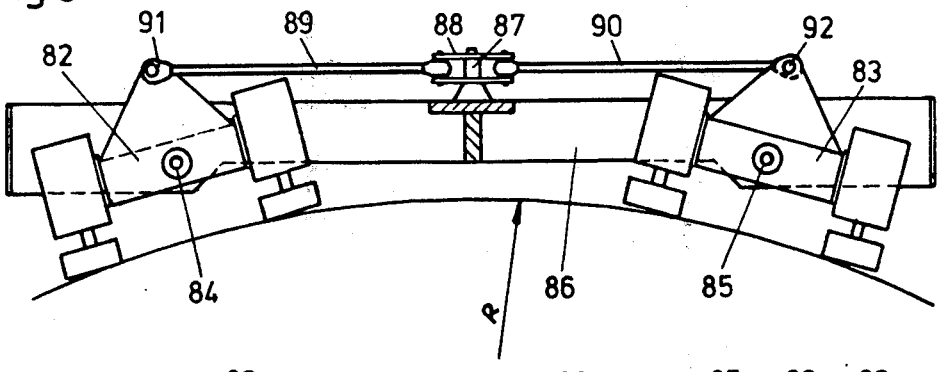
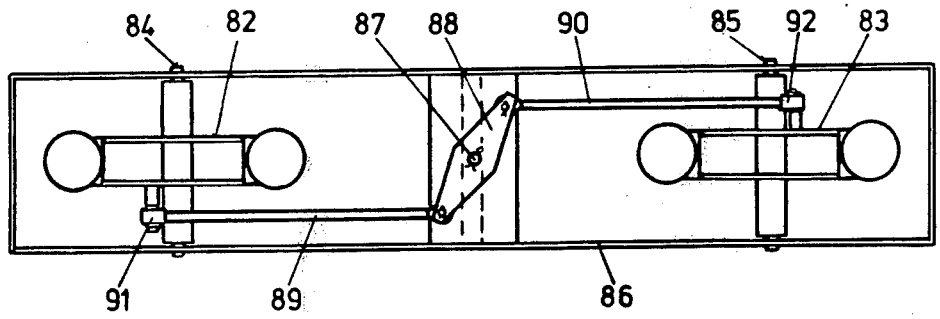
Fig.6

ABRADING ARRANGEMENT FOR A RAILWAY TRACK

BACKGROUND OF THE INVENTION

The present invention relates to a series of contact elements, in particular; abrading elements to be moved one behind the other tangentially along the bearing surface of a laid railway track.

An arrangement known in the art of the above species, starts from the point of view that when such a series of elements, used for truing the bearing surface of a railway track, encounters a change in slope on a continuous curve. The contact points in question have to be adapted to the resultant curve, dip or hump.

In an opposite case, a situation is obtained in which a straight line meets a curve. Their contact is limited to the extremities of the curve if the curvature is concave, or to a single point if the curvature is convex.

Given that the points of contact in question are partially abrading elements, only uniform contact of these elements with the rail can ensure that the work will be carried out satisfactorily.

The known arrangement provides for the movement of at least one of the contact elements towards or away from the bearing surface of the rail to be trued, with associated means for locking the contact element in predetermined positions.

According to the known arrangement, furthermore, one particular embodiment of the invention comprises two groups of contact elements. Each group is carried on a pivoted beam, and the pivotal movement of each beam is about an axis located between the two associated contact elements so that one contact element is required to move closer to the rail when the other moves away; and vice versa, each group is fitted with means for locking it in a given position. This enables the four contact points to be placed on a curve, dip, or hump, and to be maintained in the desired position.

An object of the present invention is to improve upon this embodiment so that the locking means may be dispensed with or, in any case, rendered optional.

Another object of the present invention is to provide an arrangement of the foregoing character which may be economically fabricated and readily maintained in service.

A still further object of the present invention is to provide an arrangement, as described, which has a substantially long operating life.

SUMMARY OF THE INVENTION

The objects of the present invention are achieved by providing that each of the groups of two contact points is mounted on an inclinable beam. The two beams are interconnected so that a change in the inclination of one of the beams necessarily causes a change in the inclination of the other beam. The elements of the two groups are always tangential to a negative or positive radius of curvature, including a straight line, which is their common limit, thereby rendering optional the presence of locking means for the beams.

BRIEF DESCRIPTION OF THE DRAWINGS

The accompanying drawings explain this rule geometrically — basing it on the properties of the secants of a circle — and illustrate four embodiments of the invention by way of example.

FIG. 4 shows a second embodiment of the invention, seen in vertical section;

FIG. 5 is a vertical section of a third embodiment;

FIG. 6 shows the same in plan view;

DESCRIPTION OF THE PREFERRED EMBODIMENTS

Figure 1:
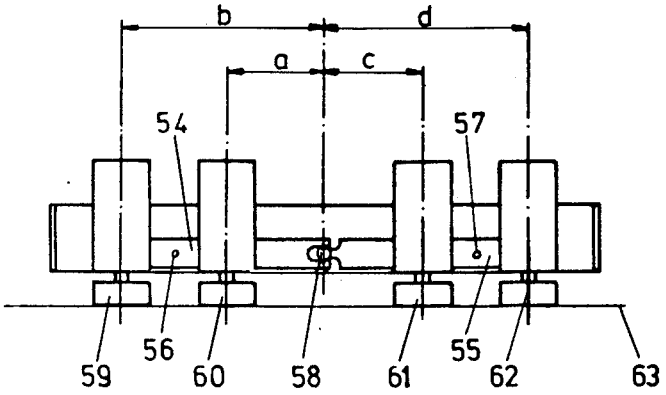
FIG. 1 shows a first embodiment of the invention and serves to illustrate the geometric rule governing the interdependent movements of the beams bearing the two groups of contact points.

In FIG. 1, the two beams are shown at 54 and 55. They are free to oscillate about pivots at 56 and 57 respectively, while the adjacent extremities of the two beams engage at 58 in such a way that when one of the beams tilts in one direction, the other beam is caused to rotate in the other direction.

On either side of the pivot points 56 and 57, the beams carry abrading elements in the present case grinders 59 and 60 on beam 54 and grinders 61 and 62 on beam 55.

These grinders constitute the contact points with the rail 63, here shown as planar.

The letters *a* and *b*, *c* and *d*, designate the distances between the axes of the grinders, perpendicular to the rail and corresponding to the points at which the grinders are mounted on the beam. A similar axis passes through point 58 at which the beams engage.

The first two distances *a* and *b* relate to the mounting points on beam 54. The two others, *c* and *d*, relate to the mounting points on the other beam 55.

The rule to be observed here is that the product of a times *b* should equal the product of *c* times *d*.

Figure 2:
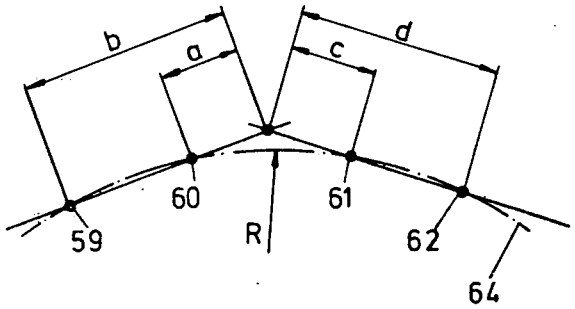
FIG. 2 shows the application of the invention to a hump of constant radius R.

With the beams free to follow the surface of the rail, a hump of constant radius R 64 (such as schematically represented in FIG. 2) would cause the beams to tilt until all four contact points 59, 60, 61, and 62 were in perfect contact with the curvature of the rail 64.

On the drawing, and in view of the exaggerated curvature of the hump, the position of the engaging point 58 does not appear to be valid. However, in practice, the radii of the humps or dips are so great that the distances *a*, *b*, *c* and *d* may be considered to be invariable.

In view of the interdependence of the positions of the grinders, it may be said that they follow the curvature of the rail in the same way as a brake shoe makes contact with and follows the curve of a wheel rim.

Given this fact, a special locking mechanism for the beams may be dispensed with.

Figure 3:
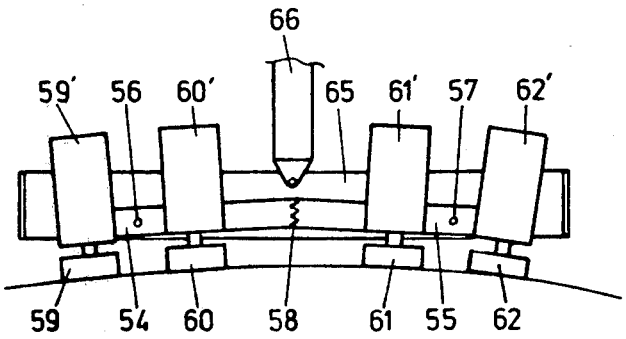
FIG. 3 shows a practical embodiment of the invention, in semi-schematic vertical section.

FIG. 3 shows, schematically, how the example described above may be realized in practice. The four grinders 59, 60, 61 and 62 — together with their individual motors — are carried by pivoted beams 54 and 55 secured to frame 65. The pivotal movement of each beam is about an axis 56 and 57 respectively. The adjacent extremities of the beams mesh at 58 by means of toothed arcs.

A jack 66 links the frame and beams to the carrying vehicle, in order to vary the pressure of the grinders on the rail or to raise them when they are not in use.

In the second embodiment, illustrated in FIG. 4, the linkage between the two beams 67 and 68 carrying the two groups of grinders 69, 70 and 71, 72, respectively, is carried out by means of connecting rods 73 and 74. Rod 73 links upper point 75 of beam 67 to lower point 76 of beam 68, while rod 74, inversely links lower point 77 of beam 67 to upper point 78 of beam 68.

The two connecting rods which cross each other, are of equal length, just as the distances between the upper and lower points would be equal if the distance between the axes of the grinders of the two groups were equal. In this case, grinders 69 and 70 are farther apart than grinders 71 and 72, and as a result, the distance between point 76 and point 78 is greater than that between points 75 and 77. Means is provided to effect adjustment of these distances.

Finally, these points are situated in pairs perpendicular to the longitudinal axis of the beam in question.

The beams tilt, of course, about central pivots 79 and 80 integral to a carrier frame (not shown) and always tilt in inverse directions.

It is nevertheless indispensable that beams 67 and 68 should have a degree of latitude to slide closer or farther away from one another; this slight movement is permitted by a slot 81 in one of the beams.

The grinders are slidably attached to the beams; this enables the distance between them to be adjusted at will, so that they work with different spacings (as shown); this avoids the possibility of the two pairs corresponding to the length of undulations to be trued.

It is a simple matter to prove that the arrangement described above permits the position of the four grinders to be adapted to any constant curve — positive (as shown) or negative — of the rail.

In the case of the third embodiment, illustrated in FIGS. 5 and 6, the two beams 82 and 83 are again mounted on pivots 84 and 85 respectively. The pivots are integral to a carrier frame 86 (in longitudinal half-section in FIG. 5).

At the center of frame 86, stands the axle 87 of a rocker mechanism 88 with two equal arms oscillating in a horizontal plane, that is, parallel or tangential to the bearing surface of the rail.

The two similar arms 89 and 90 are articulated at their extremities to the rocker 88 and to points 91 and 92 on the respective beams. Each point 91 and 92 is situated at the same distance and in a similar position in relation to the corresponding pivot 84, 85; thus, the assembly is symmetrical.

It appears obvious that with this arrangement, when one of the beams 82, 83, tilts to a certain angle, the other will tilt to the same angle in the other direction. FIG. 5 shows the assembly on a base of constant radius R.

Figure 7:
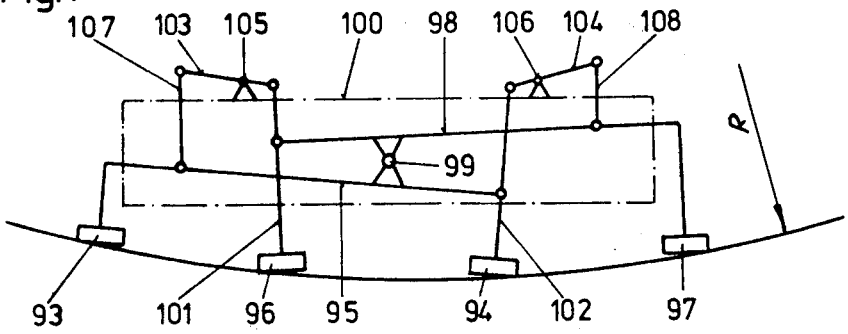
FIG. 7 shows, in vertical section, the fourth embodiment placed on a stretch of rectilinear rail.
Figure 8:
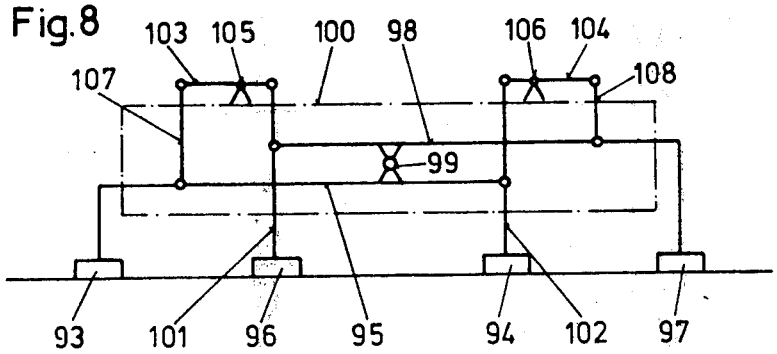
FIG. 8 shows it on a section of rail having a dip of constant radius R.

The fourth embodiment, shown in FIGS. 7 and 8, pertains to the case in which the two groups of grinders do not follow each other, but alternate instead.

One of the groups comprises grinders 93 and 94 carried by beam 95, and the other group comprises grinders 96 and 97 carried by beam 98, resulting in a partial overlap of the two beams.

Midway in this overlap, the beams are articulated at 99 to the assembly carrier frame 100. For the sake of clarity, the two beams have been drawn one below the other, while in reality they are on the same level, one beside the other. The common pivot 99 passes through each of them.

The outer end of each beam bears a grinder mounted at right angles — or at least at a fixed angle — to the axis of the beam: grinder 93 for beam 95, and grinder 97 for beam 98; these two grinders belong to different groups.

The inner end of each beam bears the other grinder, that is, 96 for beam 98, and 94 for beam 95.

The axes 101 and 102 of the latter two grinders are articulated — each at the end of its corresponding beam — and continue above the latter to articulate at the end of a rocker 103 for axis 101, and rocker 104 for axis 102. These rockers are pivotably mounted on a carrier frame 100 at 105, 106 respectively.

Rods 107 any 108 connect the free end of each of these rockers 103, 104, to the beams at 95 for the first, and 98 for the second.

Given the foregoing, these rods 107 and 108 are in reality of equal length, since the beams are at the same level and share pivot 99. Accordingly, the assembly is entirely symmetrical.

Leaving FIG. 7 — in which the grinders rest on a rectilinear rail — it can be seen from FIG. 8 that when the assembly encounters a dip of constant radius R, the four grinders necessarily assume their required positions for truing the rail.

It is clear that in order to obtain this result, care must be taken with the spacing of the grinders, the length of the beams and the size of the rockers. Once the principle is adopted, the rest is a matter of mathematics.

It should also be noted that the series of contact elements is not necessarily limited to working on the rail head, but might equally well attack any generating line of the head, and even the inside of the rail head.

Means might therefore be provided for tilting the assembly.

Without further analysis, the foregoing will so fully reveal the gist of the present invention, that others can, by applying current knowledge, readily adapt it for various applications without omitting features that, from the standpoint of prior art, fairly constitute essential characteristics of the generic of specific aspects of this invention, and therefore, such adaptations should and are intended to be comprehended within the meaning and range of equivalence of the following claims.

I claim:

1. An arrangement for truing the bearing surface of a railway track by moving a series of contact elements one behind the other tangentially of the bearing surface of a laid rail of a railway track, said elements comprising two groups of two contact elements, means for moving one of said contact elements away from the rail when the other moves towards the rail, two inclinable beams, each of said two groups being mounted on one inclinable beam, means interconnecting said two beams so that a change in the inclination of one of the beams changes the inclination of the other beam, said elements of the two groups being always tangential to the radius of curvature of the rail, said radius of curvature including negative and positive radii of curvature and a straight line.

2. The arrangement as defined in claim 1 including a carrier frame and a pivot integral therewith for mounting each beam rotatably about its central point between two elements of its group, said elements comprising grinding elements, crossed rods of equal length linking the adjacent ends of said beams so that when one beam tilts in one direction the other beam tilts in the opposite direction, and means on one of the pivots for allowing lateral displacement of the beams.

3. The arrangement as defined in claim 2 including means for varying the distance between the grinding elements of at least one of the groups, and means for varying the distance between the points at which said rods connect with one of the beams.

4. The arrangement as defined in claim 1 including a carrier frame and a pivot integral therewith for mounting each beam rotatably about its central point between two elements of the respective group, said elements comprising grinding elements, a rod connected to each beam for tilting the beam, a rocker connected to the free ends of the two rods of the beams, said rocker being also connected to said carrier frame, said two rods moving always in opposite directions and transmitting their movement to the beams.

5. The arrangement as defined in claim 1 including a carrier frame and a pivot integral therewith for mounting each beam rotatably about its central point, the four elements of the two groups alternating with each other, said beams overlapping over a predetermined length, the free outer ends of the beams each carrying a compact element solidly fixed with respect to an axis forming a constant angle with the respective beam, the axis of the other contact elements being connected at the other side of the pivot, said pivot being a common pivot to said beams, a rocker rotatably mounted on a pivot integral with said carrier frame, the axis of said other contact element connected at said pivot continuing beyond the respective beam and being connected to said rocker, and a connecting rod, the other end of said rocker being linked by said connecting rod to a point on the other beam.

6. The arrangement as defined in claim 1 including a carrier frame with integral pivots for mounting said two beams, said beams oscillating about said pivots, each pivot being located between the two contact elements carried by the respective beam, means for meshing the adjacent free ends of the beams with each other so that a rotation of one of the beams forces a rotation of the other beam in the opposite direction, said contact elements being arranged so that when placed one behind the other on a rectilinear rail, the product of the distances from the meshing point of the beams to the axes passing perpendicular to the line of contact points carried by the two beams is the same for each of them.

7. The arrangement as defined in claim 1 including means for tilting said elements transversely to the line of contact so that the rail may be contacted along any generating line of the rail head.

* * * * *